United States Patent [19]

Langley

[11] Patent Number: 4,900,298

[45] Date of Patent: Feb. 13, 1990

[54] CENTRIFUGE DRIVE AND SUPPORT ASSEMBLY

[75] Inventor: Robert W. Langley, Westminster, Colo.

[73] Assignee: Cobe Laboratories, Inc., Lakewood, Colo.

[21] Appl. No.: 88,084

[22] Filed: Aug. 21, 1987

[51] Int. Cl.[4] ..... B04B 9/14; B04B 9/00

[52] U.S. Cl. ..... 494/82; 494/46; 494/84

[58] Field of Search ..... 494/84, 85, 82, 37, 494/43, 46, 60; 68/23.3; 210/781, 782; 436/177

[56] References Cited

U.S. PATENT DOCUMENTS

| | | | |
|---|---|---|---|
| 2,583,579 | 1/1952 | Lodge | 68/23.3 |
| 3,151,074 | 9/1964 | Gooch | 494/82 |
| 3,249,215 | 5/1966 | Kelly | 68/23.3 |
| 4,114,802 | 9/1978 | Brown | 494/84 |
| 4,283,004 | 8/1981 | Lamadrid | 494/84 |

FOREIGN PATENT DOCUMENTS

| | | | |
|---|---|---|---|
| 1113439 | 9/1961 | Fed. Rep. of Germany | 68/23.3 |
| 1298279 | 9/1961 | France | 68/23.3 |
| 348387 | 10/1960 | Switzerland | 68/23.3 |

*Primary Examiner*—H. C. Hornsby
*Assistant Examiner*—M. Spisich

[57] ABSTRACT

Centrifuge drive apparatus including a support including a plurality of resilient mounting members that are spaced around a rotation axis and are intersected by a mounting plane that is perpendicular to the rotation axis, and a centrifuge bowl and drive motor assembly having a combined center of gravity in the vicinity of the mounting plane to reduce vibration.

11 Claims, 1 Drawing Sheet

CENTRIFUGE DRIVE AND SUPPORT ASSEMBLY

FIELD OF THE INVENTION

The invention relates to drive and support systems for centrifuges.

BACKGROUND OF THE INVENTION

In centrifuges a bowl that carries a sample to be separated is rotatably driven by a stationary motor, often supported by some type of resilient support system. In continuous blood separation centrifuges, whole blood is supplied to the rotating bowl and separated fractions are removed from the rotating bowl through flow paths having some segments that rotate with the bowl and other segments that are stationary and are connected to the donor/patient or collection bags on a control monitor. In some operations a sealless connection is provided between rotating and stationary segments by tubes that are carried by an arm that rotates at one-half of the bowl speed. In prior art centrifuge systems, rotating components have been statically and dynamically balanced with respect to the rotation axis to reduce vibration.

SUMMARY OF THE INVENTION

It has been discovered that centrifuge vibration could be reduced for a centrifuge bowl rotatably driven about a rotation axis by a motor supported on resilient mounting members by locating the mounting members in a mounting plane that is perpendicular to the rotation axis and providing that the center of gravity of the combined motor and bowl assembly be in the vicinity of the mounting plane.

In preferred embodiments the rotating bowl is statically and dynamically balanced with respect to the rotation axis; the rotating bowl includes a rotating tube support arm engaging inflow and outflow tubes on one side and a counterweight extending from the other side of the bowl; the motor includes a counterweight at its bottom; the resilient mounting members are supported on a plate that is connected to a base by a hollow columnar support in which the motor is located.

Other advantages and features of the invention will be apparent from the description of the preferred embodiment and from the claims.

DESCRIPTION OF THE PREFERRED EMBODIMENT

The preferred embodiment will now be described.

DRAWINGS

STRUCTURE

Figure 1:
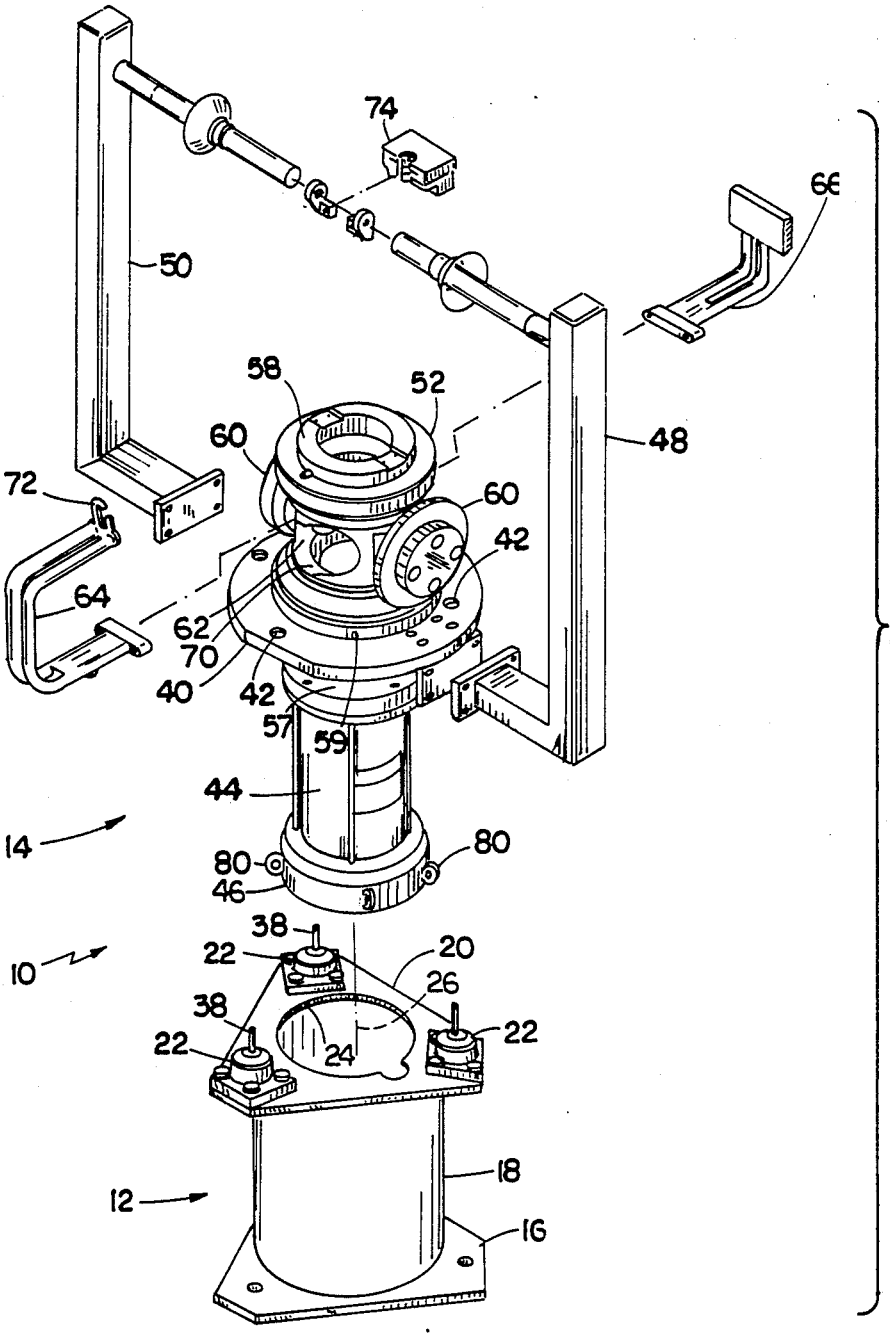
FIG. 1 is a diagrammatic partially exploded view of a support and a centrifuge bowl and drive motor assembly according to the invention.

Referring to FIG. 1, there is shown centrifuge drive apparatus 10 including support 12 and centrifuge bowl and drive motor assembly 14 for fixedly mounting thereon. Support 12 is fixedly mounted in a control monitor (not shown) that has wheels for rolling into position.

Support 12 includes base 16, hollow columnar member 18 thereabove, and platform 20 thereabove. Three resilient mounting members 22 are mounted on platform 20 and are symmetrically spaced around hole 24 and rotation axis 26.

Figure 2:
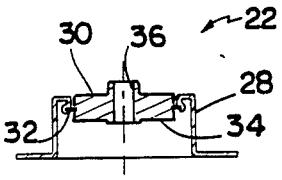
FIG. 2 is a vertical sectional view of a resilient mounting member of the support of FIG. 1.

Referring to FIG. 2, each resilient mounting member 22 includes stainless steel housing 28 and resilient natural rubber disk 30. Annular metal ring 32 is embedded in disk 30 and received in inwardly-directed annular recess 34 of housing 28. Cylindrical metal shell 36 defines a central bore for receiving bolts 38 (FIG. 1) for securing centrifuge bowl and drive motor assembly 14. Each resilient mounting member 22 has an axial spring rate of 128 lbs/in.

Figure 3:
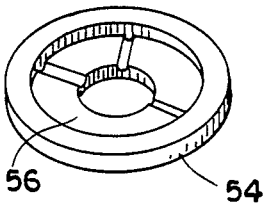
FIG. 3 is a diagrammatic perspective view of a filler component of the bowl of FIG. 1.
Figure 4:
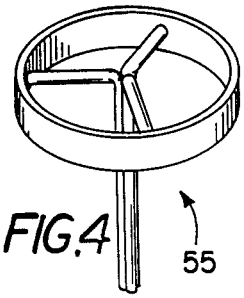
FIG. 4 is a diagrammatic perspective view of a disposable tube set including a channel carried by the FIG. 3 filler.

Referring to FIGS. 1 and 3, centrifuge bowl and drive motor assembly 14 is supported on mounting members 22 via mounting ring 40, having holes 42 receiving bolts 38. Motor 44 and counterweight 46 are supported under ring 40. Stationary tube support arms 48, 50 extend outward from ring 40 and above rotating bowl 52, which includes removable filler 54 (FIG. 3), including recess 56 for receiving a channel of a disposable tube set 55 Motor 44 is connected to ring 40 via gear assembly 57, including stationary bevel gear teeth 59 above ring 40.

Rotating bowl 52 includes all rotating members of assembly 14, including mandrel 58 (on which filler 54 is mounted), vertical bevel gears 60, housing 62 (on which gears 60 are rotatably mounted), rotating tube support arm 64 and counterweight 66. Arm 64 and counterweight 66 are mounted on housing 62. Gears 60 are driven by motor 44, and cause housing 62 to rotate, owing to engagement of their teeth with teeth 59, and cause mandrel 58 to rotate with respect to them, owing to engagement of their teeth with bevel gear teeth under mandrel 58. Thus housing 62, arm 64, and counterweight 66 all rotate at one-half of the rotation of mandrel 58. When a disposable separation channel is installed on filler 54, and both are installed on mandrel 58, the inflow and outflow tubes extend from the bottom of filler 54, through hole 70 in housing 62, around arm 64, and up through hook 72 of arm 64 to stationary tube holder 74 on support arms 48, 50.

the center of gravity of assembly 14 is in the mounting plane passing through disks 30 mentioned above. The use of counterweight 46 and the high location of ring 40 assist in achieving this condition. In addition, each of the rotating stages of rotating bowl 52 (i.e., those components rotating at full-speed with mandrel 58 and those rotating at half-speed with housing 62) are statically and dynamically balanced with respect to rotation axis 26. To achieve static balance the moment arm for mass on one side of a plane through axis 26 balances the moment arm for mass on the other side. To achieve dynamic balance the centers of mass for masses on opposite sides of a plane through axis 26 must be in the same horizontal plane perpendicular to axis 26. Rotating bowl 52 has geometrical symmetry with the exception of arm 64, which is balanced by counterweight 66, and some types of filler 54, which types include internal voids and weights to balance themselves.

OPERATION

In operation motor 44 rotates filler 54 and the disposable channel therein at desired speed. Blood flows to, and separated components flow from, the channel via tubes carried on arm 64, which rotates at half of the speed of filler 54, and keeps the tubes from becoming twisted.

The mounting of the centrifuge bowl and drive motor assembly at the mounting plane acts to reduce vibration (discussed in detail below), provide a single natural frequency to preferably be avoided, facilitate shipping and handling (as the assembly does not become unbalanced at different angles of orientation), and permits movement of the centrifuge monitor during operation without causing gyroscopic movement. To explain the low vibration advantage of apparatus 10 requires definition of the natural frequency and precession frequency.

The natural frequency of the supported assembly, $w_n$, given by the following equation:

$$w_n = \sqrt{K/I_c}$$

where:

$I_c$ is the polar moment of inertia of assembly 14 about its center of mass (approximately 3.1 lb-in-sec$^2$), and K is stiffness of the three-member, equally-spaced motor mount, given by the following equation:

$$K = \tfrac{1}{2}a^2k$$

where:

a=the diameter of the circle on which bolts 38 are mounted (7 in), and k=axial spring rate of a single resilient mounting member (128 lbs/in).

K is 3136 lb-in, and $w_n$ is approximately 300 rpm. The natural frequency thus increases with increases in the stiffness of the motor mounts. As a general principle, to avoid transmission of vibrations caused by unbalance, the operating frequency, $w_F$, should be substantially different than the natural frequency.

Precession frequency, $w_P$, which is not dependent on unbalance and is given by the equation below, should be substantially different than the natural frequency to avoid resonance of the two.

$$w_P = (I_F/I_C)w_F$$

where: $I_F$ is the moment of inertia of rotating parts about axis 26 that rotate at the operating frequency (approximately 0.33 lb-in-sec$_2$). The precession frequency is thus always about 1/10 of the operating frequency.

At the maximum operating frequency of 2400 rpm, the precession frequency is about 240 rpm, which is sufficiently below the 300 rpm natural frequency to avoid most precession. At lesser operating speeds the precession frequency is further reduced, increasing the difference. To further eliminate the chance of precession and to reduce the amplitude of vibration at the natural frequency, viscous damping is added to the systems, by using either a viscoelastic material or hydraulic dashpot to inhibit vibratory motion of assembly 14 near the natural frequency. E. g., rubber members 80 could be mounted between counterweight 46 and the inside of columnar member 18; another position could be between arms 48, 50 and a fixed member of the centrifuge machine.

At the maximum operating frequency of 2400 rpm, it is much greater than the natural frequency. The operating frequency crosses the natural frequency when building up speed or slowing down, and is close to the natural frequency during some procedures. Even when the two frequencies are close resonance problems do not appear, as the amplitude of displacement caused by unbalance is very small, owing to the balance and mounting mentioned above, and the dampening introduced into the system.

OTHER EMBODIMENTS

Other embodiments of the invention are within the scope of the claims.

What is claimed is:

1. Centrifuge drive apparatus comprising a support including a plurality of resilient mounting members that are spaced around a rotation axis and are intersected by a mounting plane that is perpendicular to said rotation axis, a centrifuge bowl and drive motor assembly including a rotatable centrifuge bowl and a drive motor supported by said mounting members, said drive motor being operable to rotatably drive said bowl about a rotation axis, said rotating bowl including a recess for receiving a channel and an opening permitting passage therethrough for inflow and outflow tubes, said centrifuge bowl and drive motor assembly having a combined center of gravity in the vicinity of said mounting plane to reduce vibration, and a disposable tube set including a separation channel received in and carried by said bowl said inflow and outflow tubes having one end attached to said channel, passing through said opening and the another end fixed to said bowl rotating means, and a midsection that is rotated by said assembly at one-half of the rotation of said bowl.

2. The apparatus of claim 1 wherein said rotatable bowl is statically and dynamically balanced with respect to said rotation axis.

3. The apparatus of claim 1 wherein said rotating bowl includes a rotating tube support arm on one side for engaging said inflow and outflow tubes and a counterweight extending from the other side.

4. The apparatus of claim 3 wherein said assembly includes a stationary tube support arm that is mounted on said motor and has a tube engaging portion mounted over said bowl that engages said another end.

5. The apparatus of claim 3 wherein said bowl includes a pair of gears driving said arm and counterweight at one-half the rotation of said liquid separation channel, said gears being mounted on opposite sides of said axis.

6. The apparatus of claim 1 wherein said support includes a platform supporting said mounting members at locations spaced from said axis and a hole through which said bowl and motor assembly passes.

7. The apparatus of claim 6 wherein said support includes a base and a columnar member supporting said platform thereabove, said columnar member including a region for receiving said motor therein.

8. The apparatus of claim 1 wherein said assembly includes a counterweight mounted on the bottom of said motor.

9. The apparatus of claim 1 wherein said resilient mounting members each include a metal housing and a resilient disk that supports said assembly at a center portion of the disk and is supported around the perphery of said disk by said metal housing.

10. The apparatus of claim 1 further comprising a viscous dampener mounted between said assembly and a fixed member fixedly connected to or comprising said support.

11. The apparatus of claim 8 wherein said support includes a base and a columnar member supporting said assembly thereabove, said columnar member including a region for receiving said motor therein, and further comprising a viscous damper mounted between said counterweight and said columnar member.

* * * * *